United States Patent [19]

Clements

[11] Patent Number: 4,502,519

[45] Date of Patent: Mar. 5, 1985

[54] CONTAINERS

[75] Inventor: Harold J. Clements, Canterbury, England

[73] Assignee: Modern Precision Engineers and Associates Limited, Kent, England

[21] Appl. No.: 478,778

[22] Filed: Mar. 25, 1983

[30] Foreign Application Priority Data

Mar. 26, 1982 [GB] United Kingdom ..... 8208932

[51] Int. Cl.[3] ..... B65D 53/00

[52] U.S. Cl. ..... 150/55; 220/232; 206/522

[58] Field of Search ..... 206/522; 150/55; 220/232, 378

[56] References Cited

U.S. PATENT DOCUMENTS 3,850,214 11/1974 Hickey ..... 150/55
4,114,668 9/1978 Hickey ..... 150/55
4,117,875 10/1978 Hickey ..... 150/55
4,140,237 2/1979 Hickey ..... 220/232
4,149,578 4/1979 Hickey ..... 150/55
4,306,665 12/1981 Hickey ..... 220/232

FOREIGN PATENT DOCUMENTS 1523002 8/1978 United Kingdom .

*Primary Examiner*—Stephen Marcus
*Assistant Examiner*—David Voorhees
*Attorney, Agent, or Firm*—Birch, Stewart, Kolasch & Birch

[57] ABSTRACT

A transportable container for the storage and transportation of goods in a hermetically sealed environment, comprising a base member and a cover member both of flexible air-impermeable sheet material, and a load-bearing structure underlying said base member and provided with at least one substantially continuous channel to receive and air-tightly interconnect the edges of said base and cover members.

8 Claims, 4 Drawing Figures

CONTAINERS

This invention relates to containers for the storage of goods in a hermetically sealed environment, and has as its main object to provide such a container which is both readily transportable and relatively inexpensive to make and to maintain.

Containers are known, for example as disclosed in British Patent Specification No. 1 379 910, which comprise a rigid air-impermeable base member, for example in the form of a steel sheet, provided with an upwardly opening channel around its perimeter for the reception, in air-tight fashion, of the edge of a flexible air-impermeable cover for the goods to be stored. The cover is flexible to facilitate partial evacuation of the container interior. This container is transportable and is satisfactory in many ways, but problems have been encountered in providing the said channel. One way of making it is by forming an upwardly projecting lip or flange all around the edge of a solid plate forming the body of the said base member, to form an inner upstanding wall of the channel, and then providing the outer upstanding wall thereof as part of a structural frame for the said base plate. This however is an expensive operation because it necessitates the use of a large press tool to form the lip or flange on the base plate, and similar expense is involved in replacing the base plate if it is damaged. An alternative procedure is to weld an upwardly opening channel section to the top face of a flat base plate all around its perimeter, but then there is a problem in achieving the necessary air-tight join between the channel section and the plate.

Containers are also known, for example as described in British Patent Specification No. 1 439 051, in which the rigid air-permeable base member mentioned above is replaced by a flexible air-impermeable sheet of similar material to the aforementioned cover and sealed to the latter around their adjoining edges, which base sheet is overlaid by one or more rigid load-bearing members which are thus located within the container. This arrangement avoids the problems involved in using a rigid air-impermeable base member and sealing it to a flexible cover, but such containers are primarily intended for the stationary storage of vehicles, which are driven on to the said internal load-bearing member(s) before the cover is applied, and their construction does not permit them to be lifted and transported with goods stored therein.

Viewed from one aspect the present invention provides a transportable container for the storage and transportation of goods in a hermetically sealed environment, comprising a base member and a cover member both of flexible air-impermeable sheet material, and a load-bearing structure underlying said base member and provided with at least one substantially continuous channel to receive and air-tightly interconnect the edges of said base and cover members.

With such an arrangement the load-bearing structure does not have to be air-impermeable because the air-tightness of the base of the container is provided by the flexible base sheet, and the problems involved is sealing a rigid air-impermeable base member to a flexible cover member are thus avoided. Furthermore the container is readily transportable.

The edges of the flexible base and cover sheets may be air-tightly interconnected, via the said channel or channels, in any of a number of alternative ways. Thus if only a single channel is provided both such edges will be received therein and air-tightly interengaged by means of, for example, the inflation of a flexible tube also housed in the channel; such a tube may be formed integrally with one or other of the said base and cover sheets, simply by rolling over and sealing the edge thereof for example, or it may be a separate tube inserted in the channel along with the edges of such sheets. Alternatively two channels may be provided, of course being airtight relative to each other and preferably formed as a single unit, and the edges of the base and cover sheets received one in each channel and air-tightly sealed thereto, again for example by means of an inflatable tube either integral with or separate from the respective sheet.

The said channel does not have to be air-tightly secured to the load-bearing structure, nor do its walls have to be air-tight in themselves, as the necessary air-tight seal is provided between the flexible base and cover sheets. This provides some notable advantages, in that firstly the channel may be formed as a relatively cheap and simple element, e.g. as a lightweight metal or plastics extrusion, whilst secondly it may be secured to the load-bearing structure in a simple and readily releasable fashion thereby facilitating replacement of the channel if it should be damaged. Furthermore the channel may advantageously be made up of a series of relatively short modular sections abutting end-to-end in nonsealing fashion so as further to reduce replacement costs.

Preferably, for added stability, the flexible base sheet is secured to the load-bearing structure not only via the engagement of its edge in the said channel. Thus in a preferred form of the invention the base sheet is clamped between a base part of the said structure and a load bearing platform carried by such base part, so that such platform is located within the hermetically sealed enclosure defined by the base and cover sheets, to directly support an article or articles to be stored therein. Preferably both such a load bearing platform and the said channel(s) are mounted for limited cushioned movement relative to the said load-bearing structure so as to accommodate small movements of a load during transportation without straining the said base and cover sheets.

Preferably means such as a suitable non-return valve is provided in either the base sheet or the cover sheet to enable the interior of the container to be evacuated to such an extent as to draw the cover sheet down into close-fitting engagement with an article or articles to be stored, so as both to restrain the latter against movement and to minimise the amount of corrosion-producing atmosphere in the container.

Two embodiments of the invention will now be described by way of example and with reference to the accompanying drawings, in which.

Figure 1:
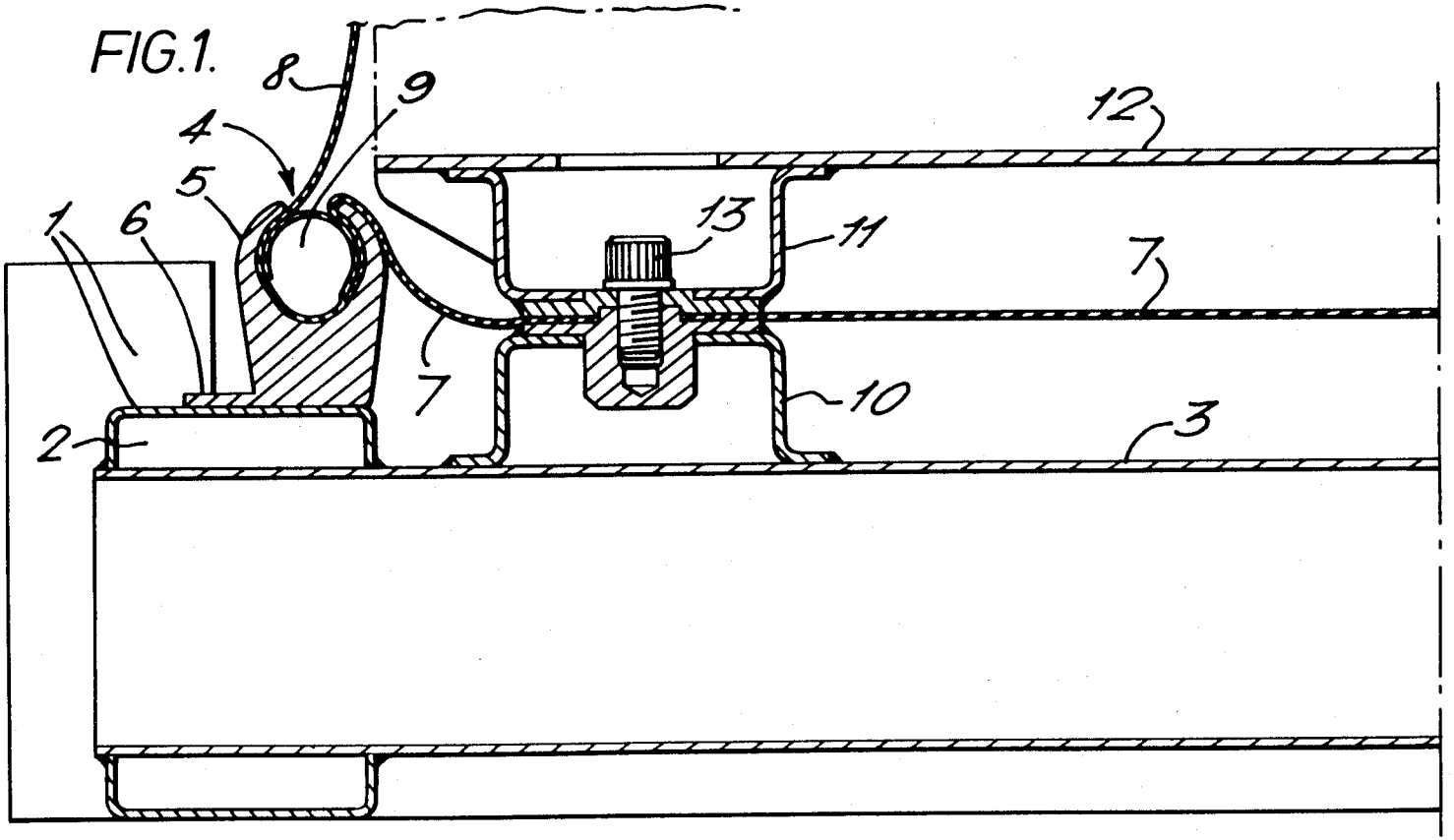
FIG. 1 is a cross-sectional view of part of a container according to a first embodiment of the invention.
Figure 2:
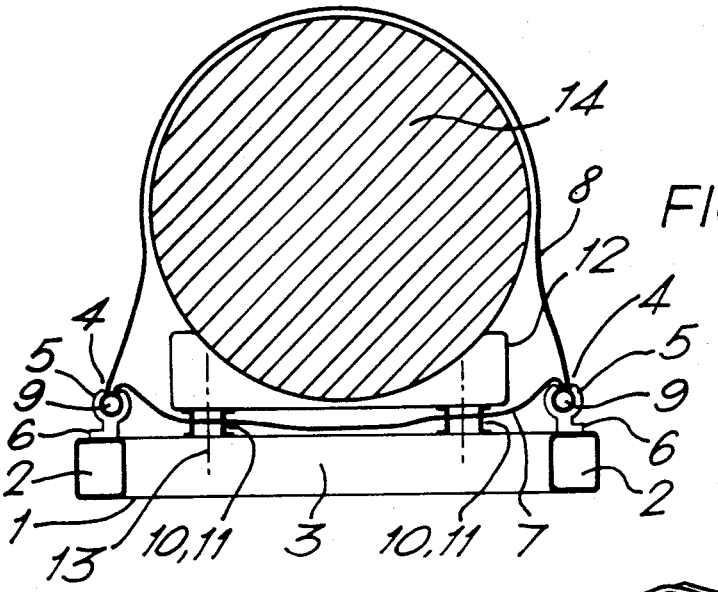
FIG. 2 is a schematic cross-sectional view of the container as a whole.
Figure 3:
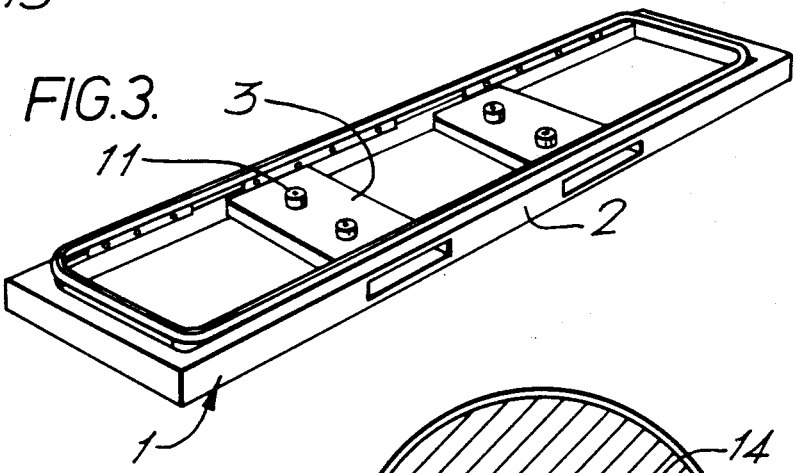
FIG. 3 is a schematic perspective view of the container with its flexible cover sheet and load-carrying platform removed.

Referring first to FIGS. 1 to 3 of the drawings, a transportable container according to the invention comprises a load-bearing structure in the form of a pallet 1 made up of a box-section frame 2 provided with two tubular cross-members 3 for the reception of fork-lift tines. An upwardly opening channel 4 defined by elongate channel members 5 extends all around the perimeter of the pallet and is secured via an integral flange 6 to the frame members 2 forming part of the pallet structure. The channel members 5 comprise a number of readily replaceable sections, which may be extrusions, including straight members and corner members, abutting end-to-end.

Received within the channel 4 are the respective edges of a base member 7 and a cover member 8 together defining an air-tight container and both made of hardwearing impermeable flexible sheet material such as natural or synthetic rubber, preferably butyl rubber. The edge of the cover sheet 8 is rolled over and sealed to define a continuous air-tight tube 9 which is received in the channel 4 and when inflated via a suitable non-return valve (not shown) serves to hold the edges of both the base and cover sheets in the channel and to form an air-tight seal between them.

The base sheet 7 is additionally secured to the pallet by being clamped between flat surfaces on upstanding mounting members 10 on the cross-members 3 and complementary seating members 11 on the underside of a load-carrying platform 12, via bolts 13 passing through the sheet 7 in air-tight fashion. The platform 12 is thus located within the air-tight container defined by the sheets 7 and 8, to directly support an article or articles 14 to be stored and transported. A non-return valve (not shown) is provided in either the base sheet 7 or the cover sheet 8 to permit partial evacuation of the container interior as aforesaid.

Hoisting attachments may be provided on the pallet 1 if desired.

Figure 4:
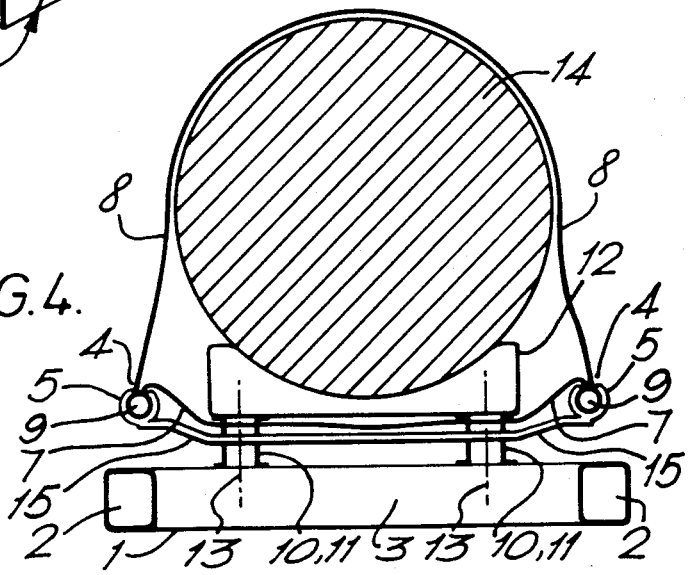
FIG. 4 is a view similar to FIG. 2 but of a second embodiment.

FIG. 4 shows an alternative arrangement in which both the channel members 5 and the load-carrying platform 12 are mounted for limited, cushioned, movement relative to the pallet 1, so that upon such movement of the platform 12, e.g. due to vibration during transportation, the channel members can move with the platform, thereby avoiding strain on the sheets 7 and 8. More specifically, cushioning elements such as rubber pads are located between the members 10 and 11, and the channel members 5 are carried by a framework 15, preferably of spider formation, mounted from members 10, 11 and of a somewhat springy construction, whereby limited cushioned movement of both the load 14 and the channel members 5 relative to the pallet 1 is accommodated.

I claim:

1. A transportable container for the storage and transportation of goods in a hermetically sealed environment, comprising a base member and a cover member both of flexible air-impermeable sheet material, and a load-bearing structure underlying said base member and provided with at least one substantially continuous channel to receive and air-tightly interconnect the edges of said base and cover members, said base member being clamped between a base part of the said load-bearing structure and a load-bearing platform carried by said base part and located within the enclosure defined by the base and cover members.

2. A container as claimed in claim 1, wherein only one said channel is provided to receive the edges of both of said base and cover members in air-tight interengagement.

3. A container as claimed in claim 2, wherein the said edges of the base and cover members are adapted to be air-tightly interengaged by the inflation of a flexible tube also received in the said channel.

4. A container as claimed in claim 3, wherein the said tube is formed integrally with one of the said base and cover members.

5. A container as claimed in claim 2, wherein the said channel comprises a lightweight metal or plastics extrusion.

6. A container as claimed in claim 2, wherein the said channel is secured to the said load-bearing structure in readily releasable fashion.

7. A container as claimed in claim 2, wherein the said channel is made up of a series of modular sections abutting end-to-end in non-sealing fashion.

8. A container as claimed in claim 1, wherein the said load-bearing platform and the said channel are mounted for limited cushioned movement relative to the said base part of the load-bearing structure.

* * * * *